US006322210B1

(12) United States Patent
Kerr et al.

(10) Patent No.: US 6,322,210 B1
(45) Date of Patent: Nov. 27, 2001

(54) COLOR PROOFING APPARATUS AND METHOD FOR WRITING INKJET IMAGES TO A PRELAMINATE SUBSTRATE

(75) Inventors: Roger S. Kerr, Brockport; Seung H. Baek, Pittsford; William L. DeMarco, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/408,857

(22) Filed: Sep. 30, 1999

(51) Int. Cl.[7] ..... B41J 2/01
(52) U.S. Cl. ..... 347/105; 347/101
(58) Field of Search ..... 347/105, 101

(56) References Cited

U.S. PATENT DOCUMENTS 5,268,708 12/1993 Harshbarger et al. .
5,800,954 * 9/1998 Kato et al. ..... 430/47
5,984,467 * 11/1999 Bodager et al. ..... 347/105
6,049,348 * 4/2000 Spurr ..... 347/234

OTHER PUBLICATIONS

J.T. Ling and R. Warner; Advances in Printing Science and Technology; Proceedings of the 19th International Conference of Printing Research Institutes, Jun. 1987, pp. 55–68.

* cited by examiner

*Primary Examiner*—John Barlow
*Assistant Examiner*—Manish S. Shah
(74) *Attorney, Agent, or Firm*—Nelson Adrian Blish

(57) ABSTRACT

A color proofing apparatus (11) for writing images to an prelaminated substrate (32) comprising an inkjet printhead (602) for writing the images to the prelaminated substrate (32). A lead screw (250) moves the inkjet printhead (602) in a first direction relative to the prelaminated substrate (32). The prelaminated substrate (32) is mounted on the vacuum imaging drum (300) which is rotated by a motor (341) relative to the inkjet printhead.

5 Claims, 10 Drawing Sheets

COLOR PROOFING APPARATUS AND METHOD FOR WRITING INKJET IMAGES TO A PRELAMINATE SUBSTRATE

FIELD OF THE INVENTION

This invention relates to color proofing in general and in particular to a color proofing apparatus and method for writing color images using ink droplets on a prelaminated substrate.

BACKGROUND OF THE INVENTION

Pre-press color proofing is a procedure used by the printing industry for creating representative images of printed material without the high cost and time required to actually produce printing plates and set up a high-speed, high-volume, printing press to produce a single example of an intended image for customer approval. The intended image may require several corrections and may need to be reproduced several times to satisfy customers requirements. Using pre-press color proofing rather than producing printing plates saves time and money.

Commonly assigned U.S. Pat. No. 5,268,708 describes an image processing apparatus having half-tone color proofing capabilities. An intended image is formed on a sheet of thermal print media by transferring dye from a sheet of dye donor material to the thermal print media by applying thermal energy to the dye donor material. This image processing apparatus is shown in FIG. 1 and is comprised of a media carousel 100; lathe bed scanning subsystem, which includes laser printhead 500; vacuum imaging drum 300; and thermal print media and dye donor material exit transports.

The operation of the image processing apparatus comprises metering a length of the thermal print media from roll 34 on carousel 100. The thermal print media is cut into sheets, transported to the vacuum imaging drum, registered, wrapped around, and secured on the vacuum imaging drum. A length of dye donor material from another roll, also on carousel 100, is metered out of the media carousel, and cut into sheets. The dye donor material is transported to and wrapped around the vacuum imaging drum, such that it is superposed in the registration with the thermal print media.

After the dye donor material is secured to the periphery of the vacuum imaging drum, the scanning subsystem writes an image on the thermal print media by focusing laser energy on the dye donor material as the thermal print media and the dye donor material on the spinning vacuum imaging drum are rotated past the printhead. A translation drive traverses the printhead axially along the vacuum imaging drum in coordinated motion with the rotating vacuum imaging drum to produce the intended image on the thermal print media.

The dye donor material is removed from the vacuum imaging drum and a second sheet of dye donor material, of a different color, is wrapped around the vacuum imaging drum in registration with the thermal print media. The imaging process is repeated with dye from the second color dye donor material being added to the intended image on the thermal print media. Additional sheets of dye donor material are processed in a similar fashion to create the intended. Once the thermal print media with the intended image leaves the exit tray it is transported to a lamination apparatus which uses heat and or pressure to transfer the image formed on the thermal print media to a paper selected by the customer.

Although the present process is satisfactory, it is not without drawbacks. The cost of a color proof from the image processing apparatus described is relatively high. For example, a different color dye donor material is needed for each color added to the thermal print media. Thus, a media carousel is required, which contains rolls of the different color dye donor material. This adds expense to the image processing apparatus. The image processing apparatus is also complicated because each different color sheet of dye donor material must be in precise registration with the thermal print media on the vacuum imaging drum. The process is time consuming because an intended image must be printed three or four times using different dye donor material to the thermal print media. Also, the vacuum drum speed is decreased each time a sheet is loaded on or removed from the drum.

One alternative to using dye donor material for color proofing is to use an ink jet to form an intended image on the media. A problem with conventional ink jet images is that the inks are in contact with the media which allows them to migrate into the media, which causes a density shift. Another possibility is to write images to an ink receiving intermediate having a polymeric layer, which is then laminated to a substrate, however, this results in unnecessary waste material and results in a prepress proof incorporating more material and which is more expensive than is necessary.

SUMMARY OF THE INVENTION

The present invention is directed to overcoming one or more of the problems set forth above. According to one aspect of the present invention a color proofing apparatus for writing images to a prelaminated substrate comprises an inkjet printhead for writing the images to the prelaminated substrate. A lead screw moves the inkjet printhead in a first direction relative to the prelaminated substrate. The prelaminated substrate is mounted on a vacuum imaging drum and a motor rotates the vacuum imaging drum relative to the inkjet printhead.

Substituting a laser printhead with an inkjet head and writing to a prelaminated substrate results in a less complicated color proofing machine using fewer parts and taking less time to produce an intended image. A multitude of different substrates can be used to prepare the color proof. The prelaminated substrate is optimized for efficient ink uptake without smearing or crystallization, preventing ink droplet spread, which would result in dot size growth due to ink droplet interaction with paper fibers or residue chemicals in the paper stock.

The image processing apparatus described above has substantial advantages. It has been found that when the ink droplets dots spread or smear, problems may result due to ink migration through paper fibers on the paper stock. Such image smear can be particularly detrimental for halftone patterns in view of the minute dot size used to form such patterns. By writing an inkjet image to a polymeric layer, ink smear and spreading due to migration of ink into the paper is eliminated and a high quality color image is obtained.

An advantage of the present invention is that it provides a dramatic decrease in the cost per prepress proof. An additional advantage of the present invention is that it provides an added margin of safety for the current image processing apparatus by using lower rotational vacuum imaging drum speeds. Waste material is also reduced.

The invention and its objects and advantages will become more apparent in the detailed description of the preferred embodiment presented below.

DETAILED DESCRIPTION OF THE INVENTION

Figure 1:
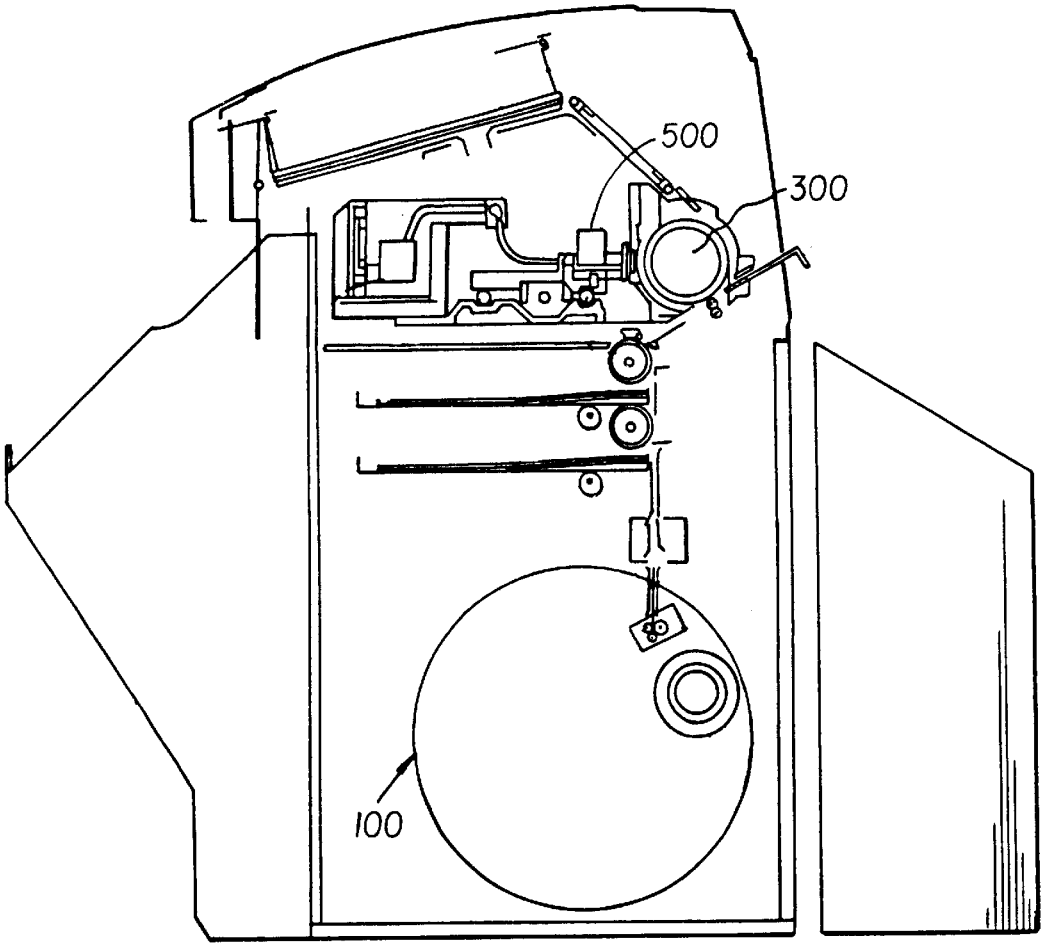
FIG. 1 (Prior Art)
FIG. 1 is a side view in vertical cross section of a prior art image processing apparatus.
Figure 2:
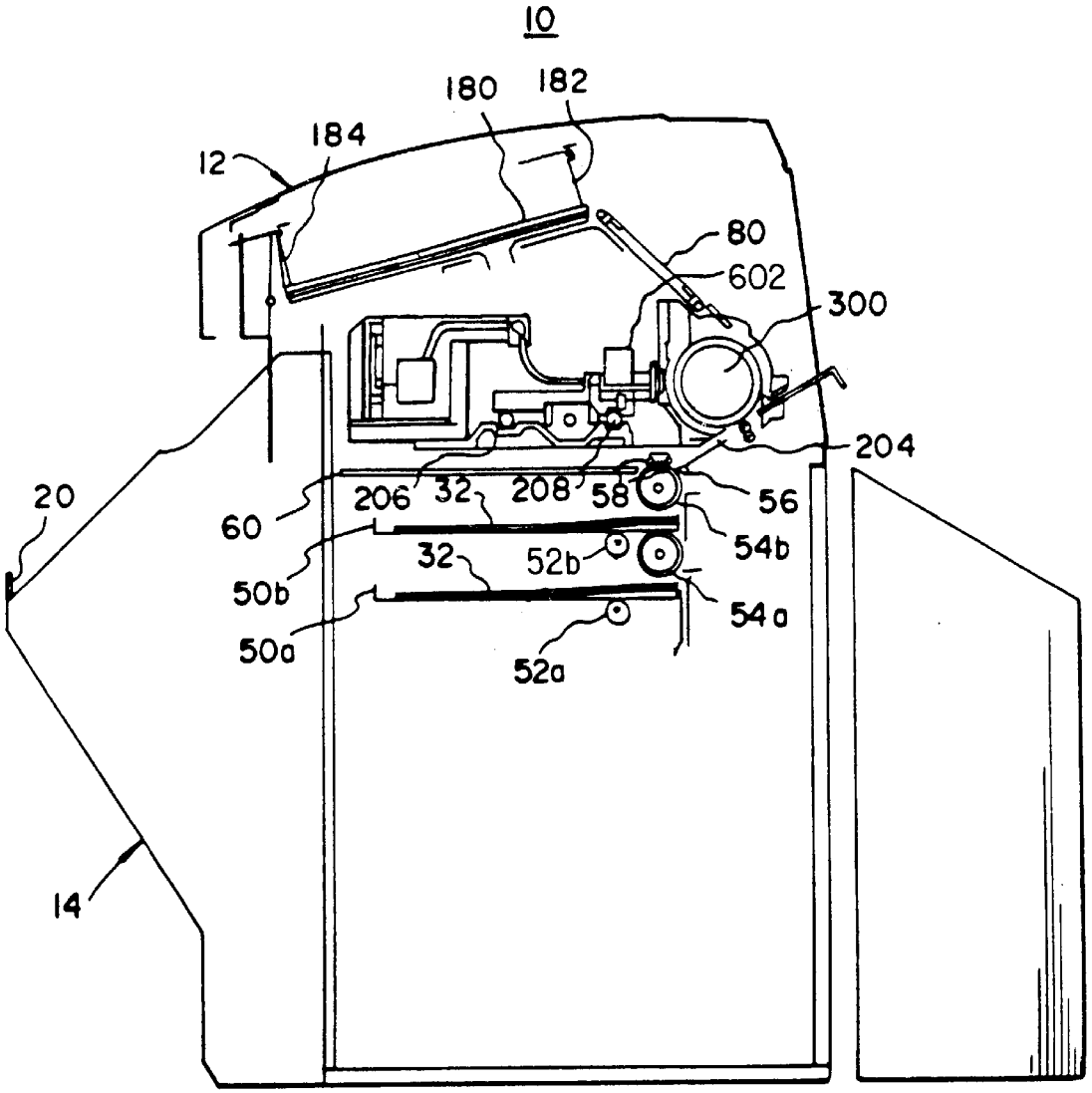
FIG. 2 is a side view in vertical cross section of an image processing apparatus according to the present invention.
Figure 3:
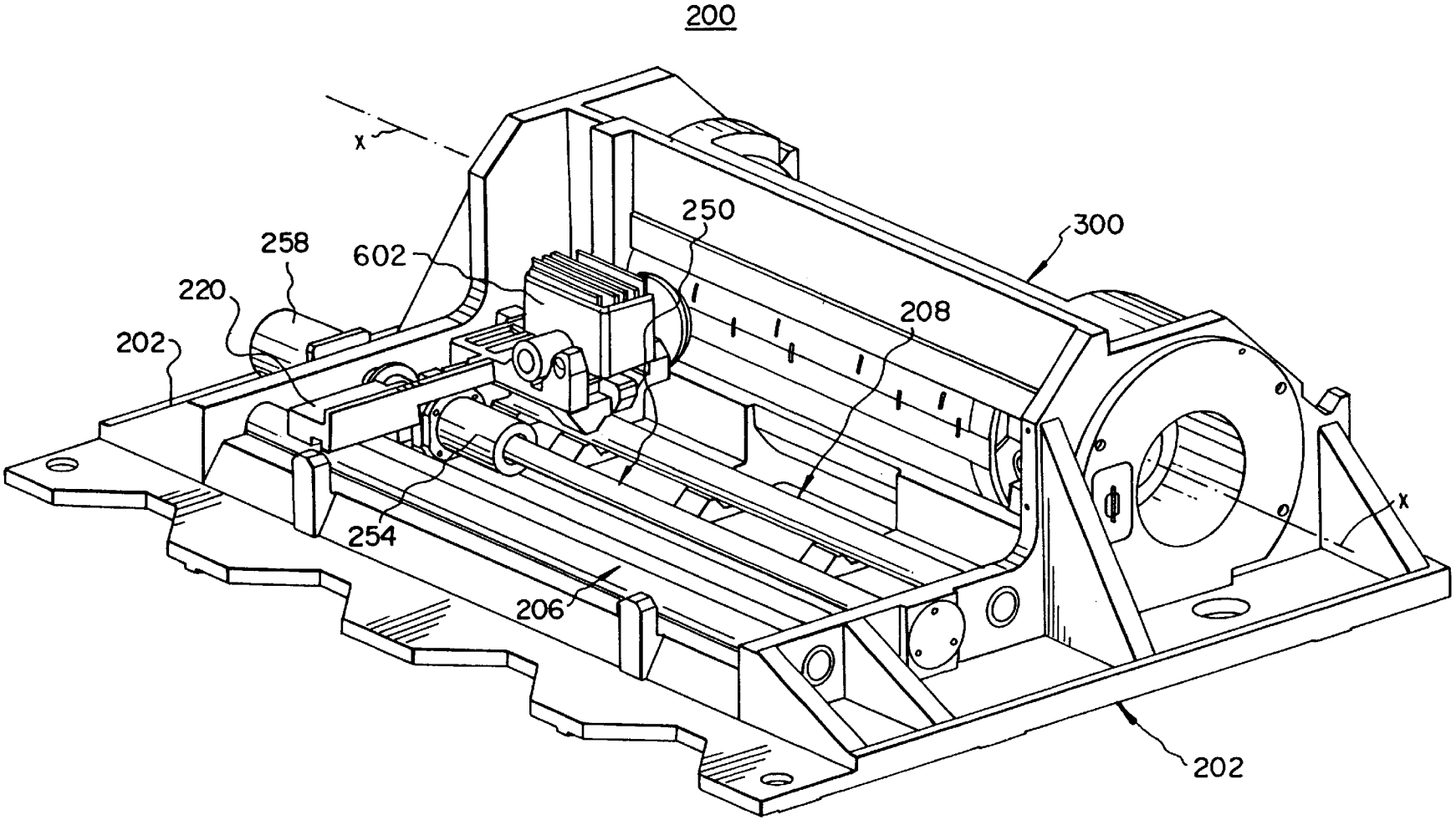
FIG. 3 is a perspective view of the lathe bed scanning subsystem of the present invention.

FIGS. 2 and 3 show an image processing apparatus 11 according to the present invention having an image processor housing 12 which provides a protective cover. A movable, hinged image processor door 14 is attached to the front portion of the image processor housing 12 permitting access to the two sheet material trays, lower sheet material tray 50*a* and upper sheet material tray 50*b*, which are positioned in the interior portion of the image processor housing 12 for holding prelaminated substrate 32. One of the sheet material trays will dispense the prelaminated substrate 32. The alternate sheet material tray holds either an alternative type of prelaminated substrate or functions as a back up sheet material tray.

The lower sheet material tray 50*a* includes a lower media lift cam 52*a* for lifting the lower sheet material tray 50*a* and ultimately the prelaminated substrate 32, upwardly toward a rotatable, lower media roller 54*a* toward a second rotatable, upper media roller 54*b*. When both rollers are rotated, the prelaminated substrate 32 is pulled upwardly towards a media guide 56. The upper sheet material tray 50*b* includes a upper media lift cam 52*b* for lifting the upper sheet material tray 50*b* and ultimately the prelaminated substrate 32 towards the upper media roller 54*b* which directs it towards the media guide 56.

The movable media guide 56 directs the prelaminated substrate 32 under a pair of media guide rollers 58 which engages the prelaminated substrate 32 for assisting the upper media roller 54*b* in directing it onto the media staging tray 60. The media guide 56 is attached and hinged to the lathe bed scanning frame 202, shown in FIG. 3, at one end, and is uninhibited at its other end for permitting multiple positioning of the media guide 56. The media guide 56 then rotates its uninhibited end downwardly, as illustrated in the position shown, and the direction of rotation of the upper media roller 54*b* is reversed for moving the prelaminated substrate 32 resting on the media staging tray 60 under the pair of media guide rollers 58, upwardly through an entrance passageway and around a rotatable vacuum imaging drum 300.

The inkjet printhead 602 directs nozzles which spurt imagewise ink droplets onto prelaminated substrate 32 forming an intended image on the prelaminated substrate 32. The inkjet printhead 602 is attached to a lead screw 250, shown in FIG. 3, via a lead screw drive nut 254 and drive coupling, not shown, which move axially along a longitudinal axis of the vacuum imaging drum 300. Inkjet printhead 602 creates the intended image onto the prelaminated substrate 32.

The vacuum imaging drum 300 rotates at a constant velocity. During writing of an image to prelaminated substrate 32 the vacuum imaging drum rotation is slowed during the loading and unloading of the prelaminated substrate. Inkjet printhead 602 begins at one end of the prelaminated substrate 32 and traverses the entire length of the prelaminated substrate 32.

After the color has been transferred the imaged prelaminated substrate 33 it is removed from the vacuum imaging drum 300 and transported via a transport mechanism 80 to colorant binding assembly 180. The entrance door 182 of the colorant binding assembly 180 is opened allowing the image prelaminated substrate 33 to enter the colorant binding assembly 180, and shuts once the imaged prelaminated substrate 33 comes to rest in the colorant binding assembly 180. The colorant binding assembly 180 processes the imaged prelaminated substrate 33 to further binding the transferred colors on the imaged prelaminated substrate 33 and to seal the microbeads. After the color binding process has been completed, the media exit door 184 is opened and the imaged prelaminated substrate 33 with the intended image thereon passes out of the colorant binding assembly 180 and the image processor housing 12 and comes to rest against a media stop 20.

FIG. 3 shows a perspective view of the lathe bed scanning subsystem 200 of the image processing apparatus 11, including the vacuum imaging drum 300, inkjet printhead 602, and lead screw 250, which is mounted on the lathe bed scanning frame 202. The vacuum imaging drum 300 is mounted for rotation about an axis X in the lathe bed scanning frame 202. The inkjet printhead 602 is movable with respect to the vacuum imaging drum 300, and is arranged to direct ink droplets to the prelaminated substrate 32. The ink from the inkjet printhead 602 for each nozzle is modulated individually by electronic signals from the image processing apparatus 11, which are representative of the shape and color of the original image, so that the color is applied only in those areas in which its presence is required on the prelaminated substrate 32 to reconstruct the shape and color of the original image.

The inkjet printhead 602 is mounted on a movable translation stage member 220 which, in turn, is supported for low friction slidable movement on translation bearing rods 206 and 208. The translation bearing rods 206 and 208 are sufficiently rigid so as not to sag, and are parallel to the axis X of the vacuum imaging drum 300. The axis of the inkjet printhead 602 is perpendicular to the axis X of the vacuum imaging drum 300 axis. The front translation bearing rod 208 locates the translation stage member 220 in the vertical and the horizontal directions with respect to axis X of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the inkjet printhead 602 during the generation of an intended image.

Lead screw 250 has an elongated, threaded shaft which is attached to a linear drive motor 258 on its drive end and to the lathe bed scanning frame 202 by means of a radial bearing. A lead screw drive nut 254 includes grooves in its hollowed-out center portion for mating with the threads of the threaded shaft 252 to permit the lead screw drive nut 254 to move axially along the threaded shaft as the threaded shaft is rotated by the linear drive motor 258. The lead screw drive nut 254 is integrally attached to the to the inkjet printhead 602 through the lead screw coupling and the translation stage member 220, so that as the threaded shaft is rotated by the linear drive motor 258 the lead screw drive nut 254 moves axially along the threaded shaft 252 which in turn moves the translation stage member 220 and ultimately the inkjet printhead 602 axially along the vacuum imaging drum 300.

The lead screw 250 operates as follows. The linear drive motor 258 is energized and imparts rotation to the lead screw 250 causing the lead screw drive nut 254 to move axially along the threaded shaft 252. Annular-shaped axial load magnets, not shown, are magnetically attracted to each other and prevent axial movement of the lead screw 250. A ball bearing, not shown, permits rotation of the lead screw 250 while maintaining the positional relationship of the annular-shaped axial load magnets, which prevents mechanical friction between them while permitting the threaded shaft 252 to rotate.

Figure 4:
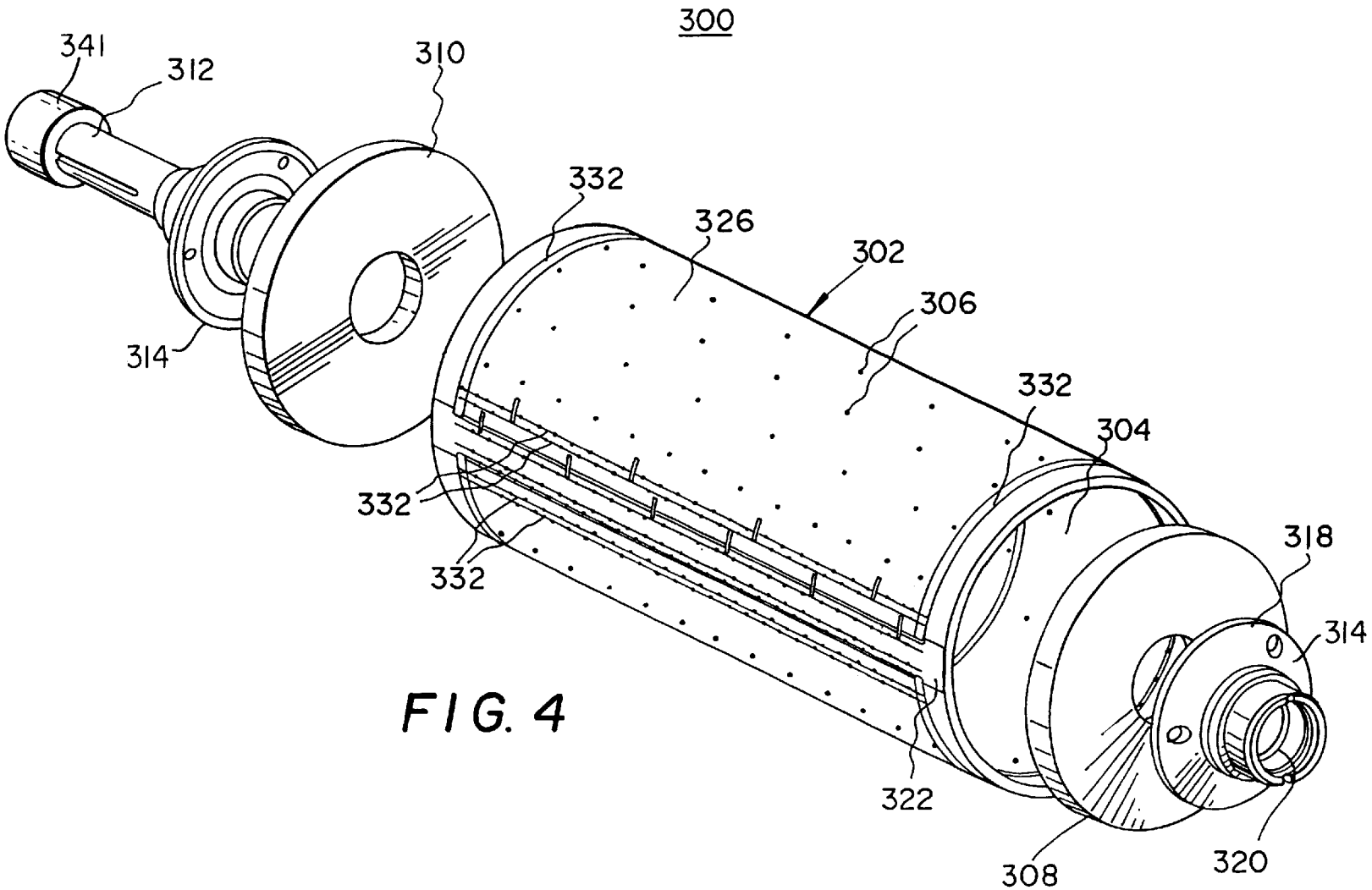
FIG. 4 is an exploded perspective view of the vacuum imaging drum of the present invention.

FIG. 4 illustrates an exploded view of the vacuum imaging drum 300. The vacuum imaging drum 300 has a cylindrical shaped vacuum drum housing 302 that has a hollowed-out interior portion 304, and further includes a plurality of vacuum grooves 332 and vacuum holes 306 which extend through the vacuum drum housing 302 allowing a vacuum to be applied from the hollowed-out interior portion 304 of the vacuum imaging drum 300 for supporting and maintaining position of the prelaminated substrate 32 as the vacuum imaging drum 300 rotates.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314. The vacuum end plate 308 is provided with a centrally disposed vacuum spindle 318 which extends outwardly therefrom through another support bearing 314.

The drive spindle 312 extends through the support bearing 314 and is stepped down to receive a DC drive motor armature which is held on by means of a drive nut. A DC motor 341 is held stationary by the late bed scanning frame member 202. The reversible, variable DC motor 341 drives the vacuum imaging drum 300. A drum encoder provides timing signals to the image processing apparatus 11.

The vacuum spindle 318 is provided with a central vacuum opening 320 which is in alignment with a vacuum fitting, not shown, with an external flange that is rigidly mounted to the lathe bed scanning frame 202. The vacuum fitting has an extension which is closely spaced from the vacuum spindle 318 forming a small clearance. With this configuration, a slight vacuum leak is provided between the outer diameter of the vacuum fitting and the inner diameter of the central vacuum opening 320 of the vacuum spindle 318. This assures that no contact exists between the vacuum fitting and the vacuum imaging drum 300 which might impart uneven movement or jitters to the vacuum imaging drum 300 during its rotation.

The opposite end of the vacuum fitting is connected to a high-volume vacuum blower, not shown, which produces 93.5–112.2 mm of mercury at an air flow volume of 28.368–33.096 liters per second. With no media loaded on the vacuum imaging drum 300 the internal vacuum level of the vacuum imaging drum 300 is approximately 18.7–28.05 mm mercury. When the prelaminated substrate 32 is loaded on the vacuum imaging drum 300 the internal vacuum level of the vacuum imaging drum 300 is approximately 93.5–112.2 mm of mercury.

Figure 5:
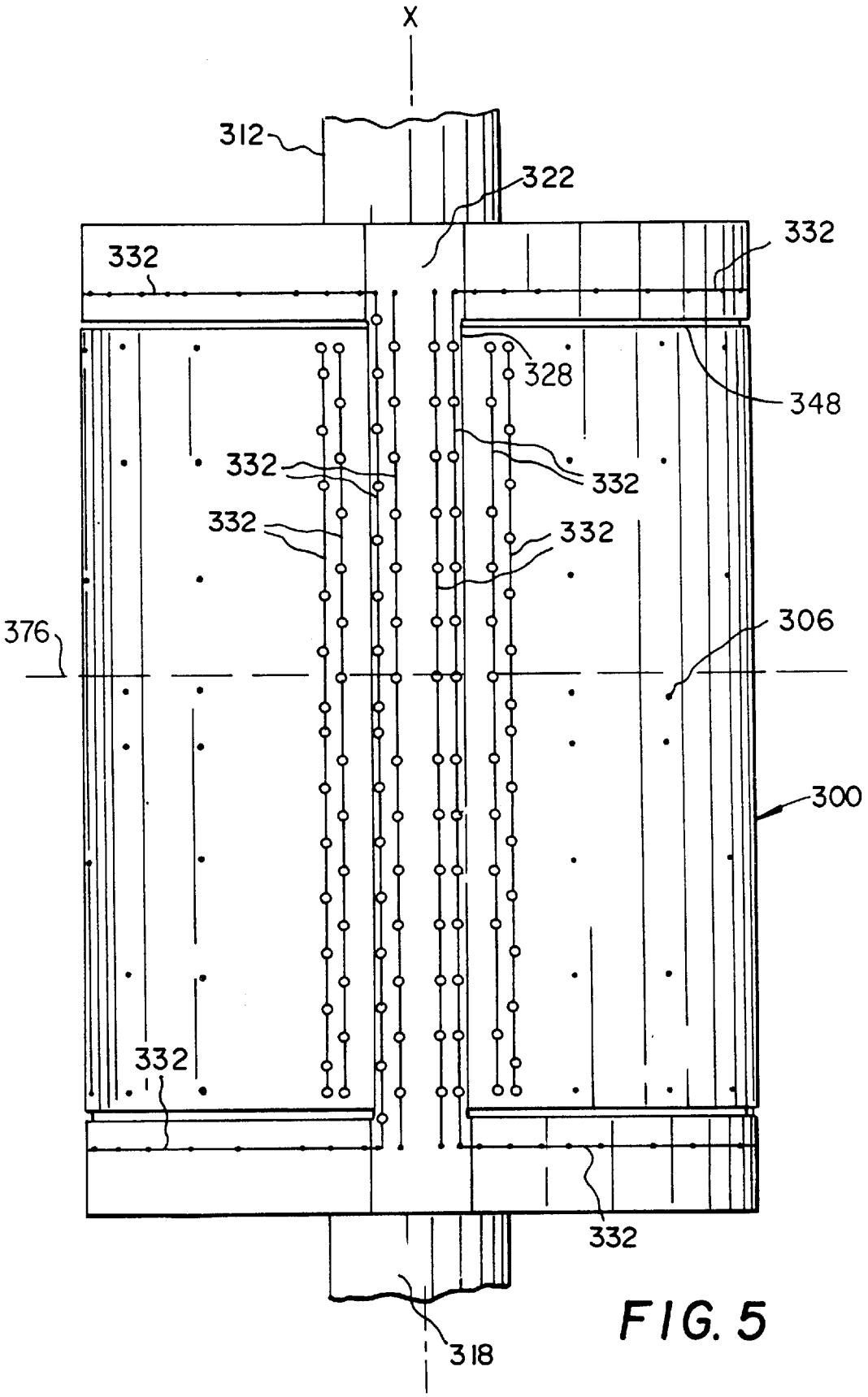
FIG. 5 is a plan view of the vacuum imaging drum according to the present invention.

The outer surface of the vacuum imaging drum 300 is provided with an axially extending flat 322, shown in FIGS. 4 and 5, which extends approximately 8 degrees around the vacuum imaging drum 300 circumference. The axially extending flat 322 assures that the leading and trailing ends of the prelaminated substrate 32 are some what protected from the effect of increased air turbulence during the relatively high speed rotation that the vacuum imaging drum 300 undergoes during the image scanning process. Thus increased air turbulence will have less tendency to lift or separate the leading or trailing edges of the prelaminated substrate 32 from the vacuum imaging drum 300. Also, the axially extending flat 322 ensure that the leading and trailing ends of prelaminated substrate 32 are recessed from the vacuum imaging drum 300 periphery. This reduces the chance that the prelaminated substrate 32 can come in contact with other parts of the image processing apparatus 11, such as the inkjet printhead 602, which could cause a media jam within the image processing apparatus, resulting in the possible loss of the intended image or worse catastrophic damage to the image processing apparatus 11.

Figure 6A:
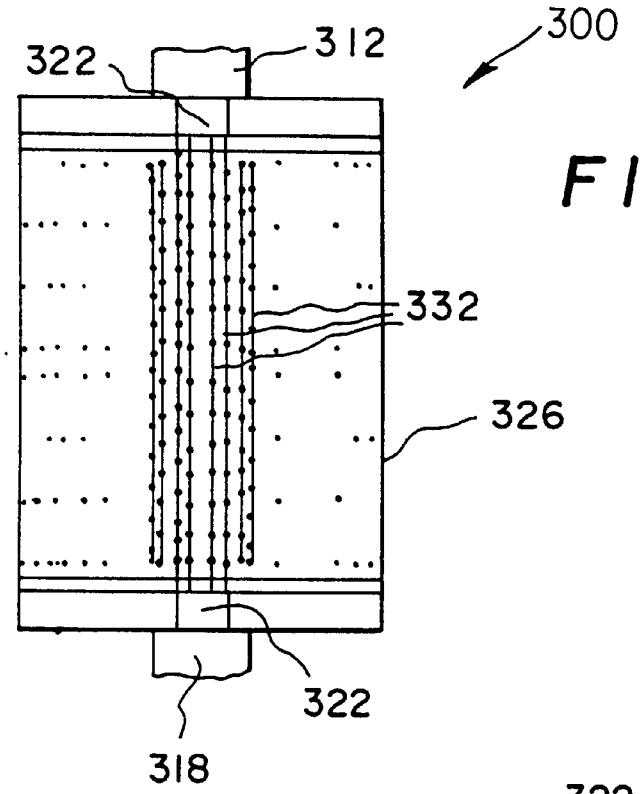
FIGS. 6*a* and 6*b* are plan views showing the vacuum imaging drum without and with, respectively, an prelaminated substrate.
Figure 6B:
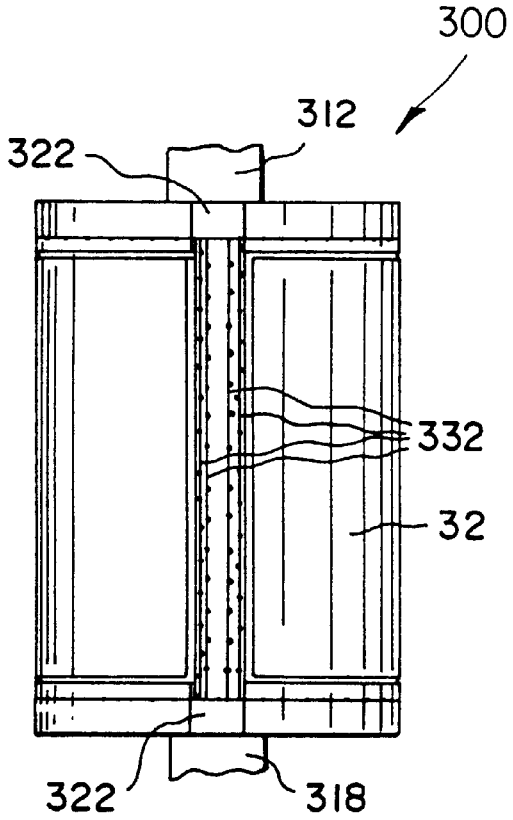

Loading and unloading the prelaminated substrate 32 onto and off from the vacuum imaging drum 300, requires precise positioning. FIG. 6*a* shows a plan view of vacuum imaging drum 300 prior to loading prelaminated substrate 32. FIG. 6*b*, by comparison, shows a plan view of vacuum imaging drum 300 with prelaminated substrate 32 loaded and wrapped around vacuum imaging drum 300. The lead edge positioning of the prelaminated substrate material must be accurately controlled during this process. A multi-chambered vacuum imaging drum is used for such lead-edge control. One appropriately controlled chamber applies vacuum that holds the lead edge of the prelaminated substrate. Another chamber, separately valved, controls vacuum that holds the trail edge of the prelaminated substrate the vacuum imaging drum. Loading a sheet of prelaminated substrate 32 requires that the image processing apparatus feed the lead edge of the prelaminated substrate 32 into position just past the vacuum ports controlled by the respective valved chamber. Then vacuum is applied, gripping the lead edge of prelaminated substrate against the vacuum imaging drum surface.

Unloading the imaged prelaminated substrate 33 requires the removal of vacuum from these same chambers so that an edge of the imaged prelaminated substrate is freed and project out from the surface of the vacuum imaging drum. The image processing apparatus then positions an articulating skive into the path of the free edge to lift the edge further and to feed the imaged prelaminated substrate to a waste bin or an output tray.

The imaged prelaminated substrate exit transport comprises a movable imaged prelaminated substrate stripper blade disposed adjacent to the upper surface of the vacuum imaging drum. In the unload position, the stripper blade is in contact with the imaged prelaminated substrate on the vacuum imaging drum surface. In the inoperative position, it is moved up and away from the surface of the vacuum imaging drum 300. An imaged prelaminated substrate transport belt is arranged horizontally to carry the imaged prelaminated substrate removed by the stripper blade from the surface of the vacuum imaging drum. It then delivers the imaged prelaminated substrate with the intended image formed thereon to an exit tray in the exterior of the image processing apparatus.

Figure 7:
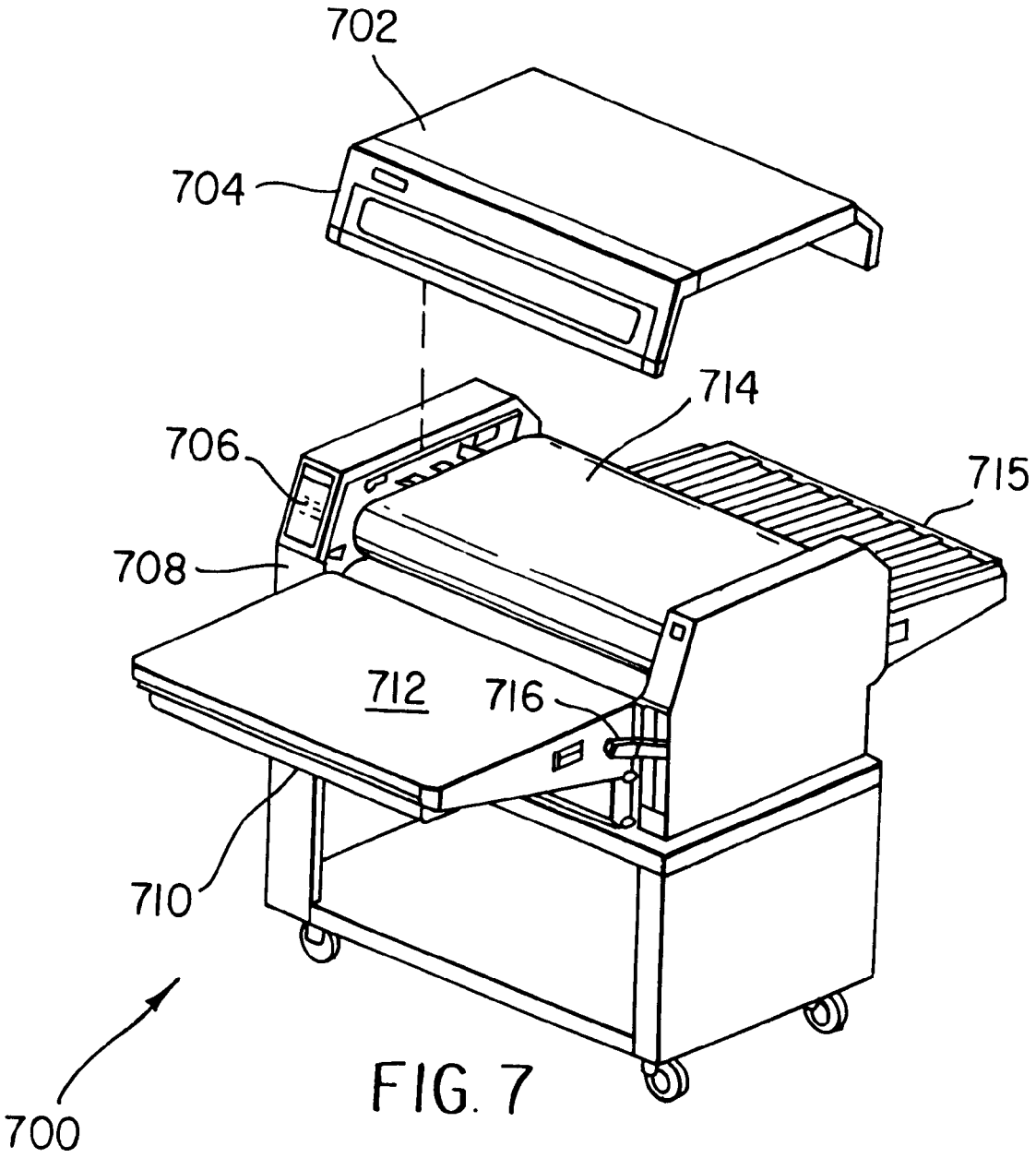
FIG. 7 is an exploded perspective view of a laminator according to the present invention.

The imaged prelaminated substrate 33 with the intended image is transported to the exit tray and taken to a laminator 700, shown in FIG. 7, which uses heat and or pressure to prepare the prelaminated substrate. Laminator 700 is comprised, in general, of a front access door 702 and a safety door 704. A control panel 706 controls the operation of the machine and a safety switch 708 is used to turn the machine off. Storage slots 710 are for extra material. The sheets to be laminated are placed on entrance trays 712 and are fed by belts 714 through the laminator. Pressure lever 716 applies pressure to the sheets to be laminated while heat is simultaneously applied.

Figure 8:
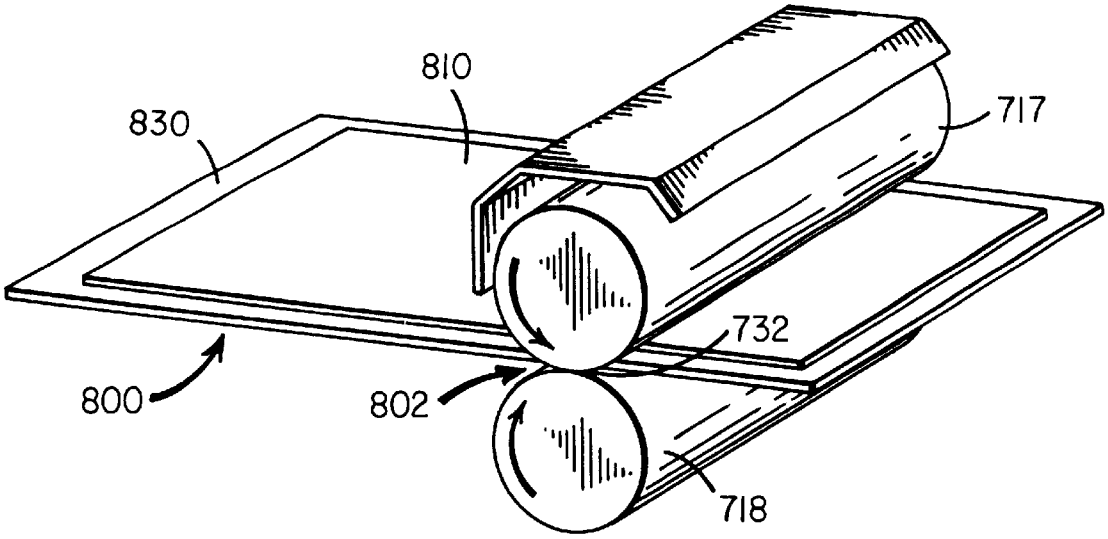
FIG. 8 shows a perspective view of a laminator according to the present invention.
Figure 9:
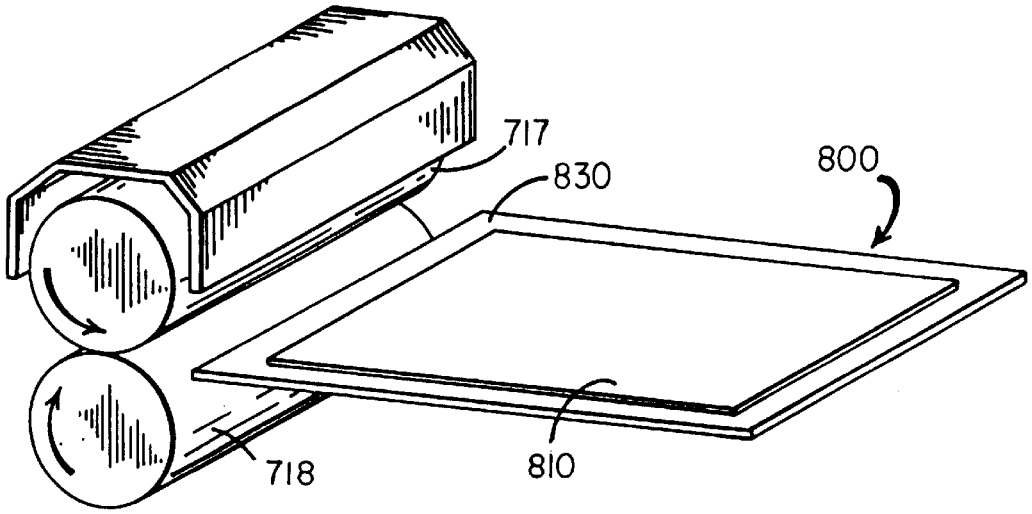
FIG. 9 shows a perspective view of a laminator according to the present invention.
Figure 10:
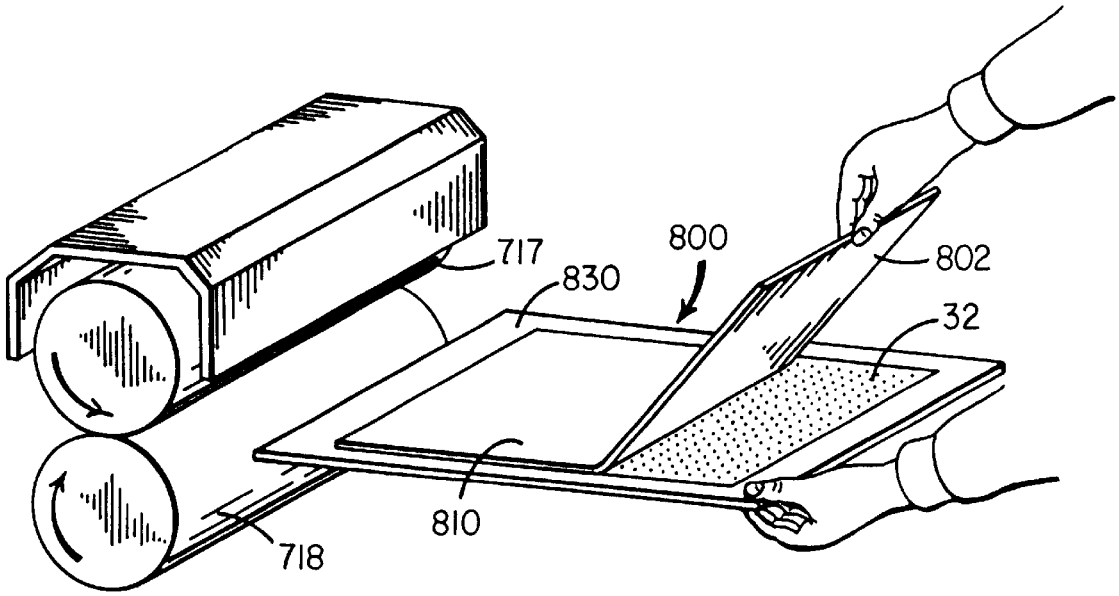
FIG. 10 shows a perspective view of a laminator according to the present invention.

Referring now to FIGS. 8–10, lamination 800 made up of prelaminate 830 positioned on paper substrate 810. Prelaminate 830 is comprised of a support layer 802, separation layer 803, and polymeric layer 804. Lamination 800 travels along a media passage 802 to a nip portion 732 between heated pressure rollers 717 and 718. Upper heated pressure roller 717 and lower heated pressure roller 718 each contain a heating element, not shown, that respectively applies heat to the surfaces of upper heated pressure roller 717 and lower heated pressure roller 718. Pressure is applied to upper heated pressure roller 717 and lower heated pressure roller 718 in a known manner by, for example, eccentrics, or levers. Lower heated pressure roller 718 is driven such that when upper heated pressure roller 717 and lower heated pressure roller 718 are pressed together they both rotate.

A lead edge of lamination 800 is fed into nip portion 732 formed by upper heated pressure roller 717 and lower heated pressure roller 718. Lamination 800 is heated and substrate 810 positioned on prelaminate 830 and are pressed together as they pass through nip portion 732. As lamination 800 emerges from nip portion 732, the stiffness of lamination 800 causes it to continue along the surface of an exit table 715 shown in FIG. 7, until it exits nip portion 732; rather than being wrapped around upper heated pressure roller 717 or lower heated pressure roller 718. After the lamination 800 cools sufficiently, a support layer 802 is peeled from the laminated leaving behind a prelaminated substrate 32.

The prelaminated substrate 32 that is used in the present invention is imaged with color dyes or pigments which permits a wide selection of hue or color that enables a closer match to a variety of printing inks. In the color proofing industry, it is important to be able to match the proofing ink references provided by the International Prepress Proofing Association. These ink references are density patches made with standard 4-color process inks and are known as SWOP (Specifications Web Offset Publications) Color References. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, P. 55.

Figure 11:
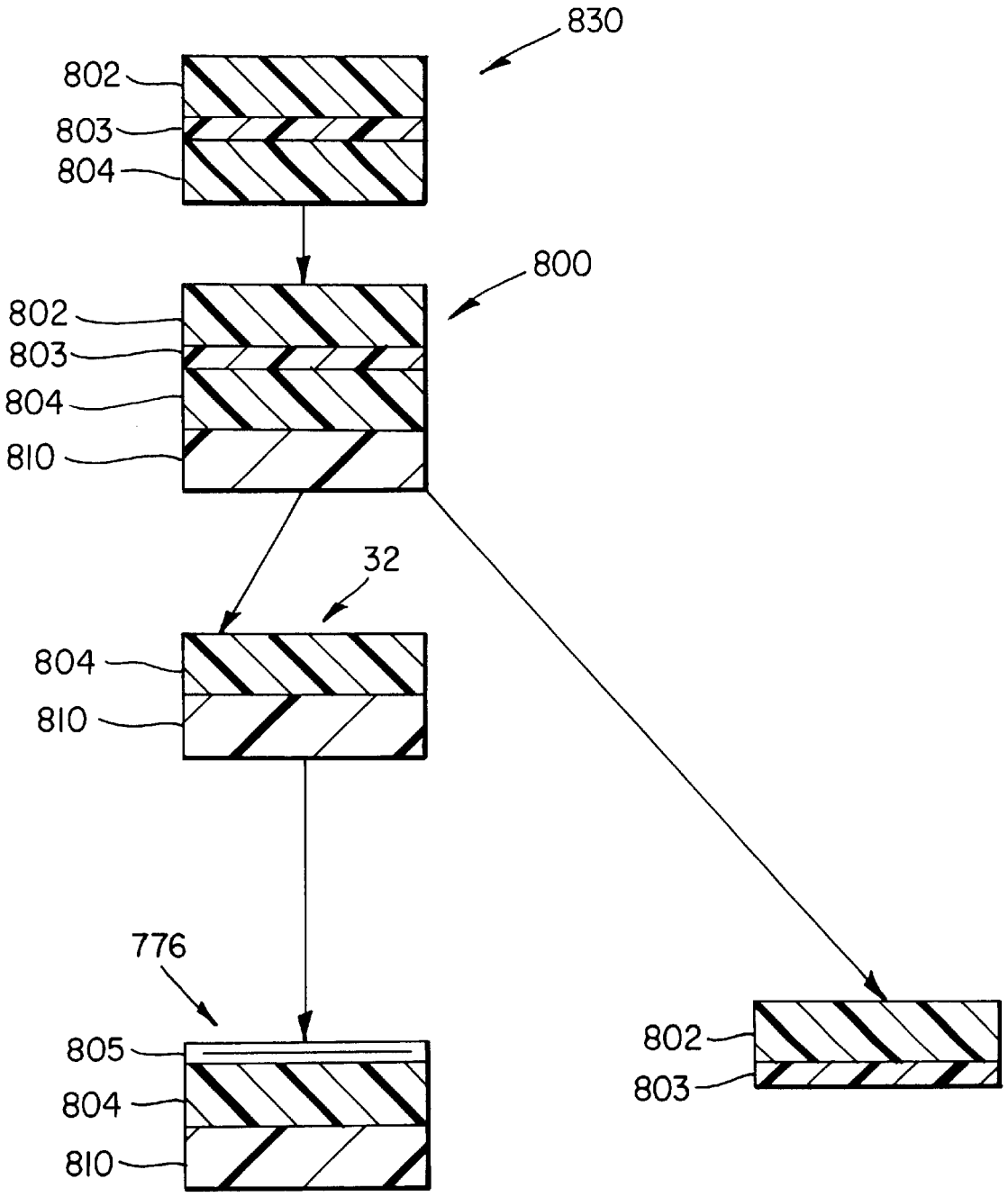
FIG. 11 is a flow diagram of a color proofing method according to the present invention.

The prelaminate 830 comprises a support layer 802 having a polymeric layer 804 as shown in FIG. 11. A separation layer 803 is located between support layer 802 and polymeric layer 804 The support layer 802 may be a polymeric film such a poly(ether sulfone), a plyimide, a cellulose ester such as cellulose acetate, a poly(vinyl alcohol-co-acetal) or a poly(ethylene terephathalate). The support thickness is not critical, but should provide adequate dimensional stability. In general, polymeric film supports of from 5 to 500 micron are used. The support may be clear, opage, or diffusely or specularly reflective.

The polymeric layer 804 may comprise, for example, a polycarbonate, a polyurethane, a polyester, polyvinyl chloride, cellulose esters such as cellulose acetate butyrate or cellulose acetate propionate, poly(styrene-co-acrylonitrile), poly(caprolactone), polyvinylacetals such as poly(vinyl alcohol-co-butyral), mixtures thereof, or any other conventional polymeric ink-receiver material provided it will adhere to the second receiver. The polymeric layer may be present in any amount which is effective for the intended purpose. In general, good results have been obtained at a concentration of from about 02. to about 5 $g/m^2$.

In the preferred embodiment the separation layer is comprised of release agents, included between the support layer 802 and polymeric layer 804, which facilitate separation. The release layer comprises a mixture of hydrophilic cellulosic materials and polyethyleneglycol.

The invention has been described in detail with particular reference to certain preferred embodiments thereof, but it will be understood that variations and modifications can be effected within the scope of the invention.

PARTS LIST

10. Image processing apparatus
11. Inkjet color proofing apparatus
12. Image processor housing
14. Image processor door
20. Media stop
32. Prelaminated substrate
33. Image prelaminated substrate
36. Dye donor material
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
98. Master lathe bed scanning engine
100. Media carousel
162. Stepper Motor
180. Color binding assembly
182. Media entrance door
184. Media exit door
198. Master Lathe Bed Scanning Engine
200. Lathe bed scanning subsystem
202. Lathe bed scanning frame
206. Rear translation bearing rod
208. Front translation bearing rod
210. Alignment mark
212. Prick punch
214. Capacitance probe
218. Rod support slots
220. Translation stage member
224. Vacuum blower
226. Adjustment screw
228. Set screw
230. Movable end plate
232. Adjustable support plate

240. Linear translation subsystem
250. Lead screw
254. Lead screw drive nut
258. Linear drive motor
300. Vacuum imaging drum
301. Axis of rotation
302. Vacuum drum housing
304. Hollowed out interior portion
306. Vacuum hole
308. Vacuum end plate
310. Drive end plate
312. Drive spindle
314. Support bearing
318. Vacuum spindle
320. Central vacuum opening
322. Axially extending flat
326. Cicumferential recess
332. Vacuum grooves
341. DC motor
454. Optical centerline
488. Prelaminate
490. Laminator
492. Pressure Roller
494. Heating element
500. Laser printhead
502. Head angle adjustment
504. Focus adjustment
602. Inkjet printhead
700. Laminator
702. Front access door
704. Safety door
706. Control panel
708. Safety switch
710. Storage slots
712. Entrance trays
714. Belt
715. Exit table
716. Pressure lever
717. Upper heated pressure roller
718. Lower heated pressure roller
732. Nip portion
776. Prepress proof
800. Lamination
802. Support layer
803. Separation layer
804. Polymeric layer
805. Intended image
810. Paper substrate
830. Prelaminate

What is claimed is:

1. A color proofing method comprising the steps of:

laminating a support layer, a separation layer, and a polymeric layer to form a prelaminate;

laminating a substrate to said prelaminate;

removing said support layer and said separation layer from said polymeric layer to form a prelaminated substrate; and creating a color image on said polymeric layer using an inkjet printhead.

2. A color proofing method comprising the steps of:

laminating a support layer, a separation layer, a polymeric layer, and a substrate to form a lamination;

separating said support layer and said separation layer from said polymeric layer and said substrate to form a prelaminated substrate; and imaging said polymeric layer of said prelaminated substrate with an inkjet printhead to create a prepress proof.

3. A color proofing apparatus as in claim 1 wherein said support layer is selected from a group comprised of:

poly(ether sulfone), plyimide, cellulose acetate, poly (vinyl alcohol-co-acetal), and poly(ethylene terephthalate).

4. A color proofing apparatus as in claim 1 wherein said separation layer is comprised of a mixture of hydrophilic cellulosic materials and polyethyleneglycol.

5. A color proofing apparatus as in claim 1 wherein said polymeric layer is selected from a group comprised of:

polycarbonate, polyurethane, polyester, polyvinyl chloride, cellulose esters, cellulose acetate propionate, poly(stryene-co-acrylonitrile), and poly(caprolactone).

* * * * *